US006517331B1

(12) United States Patent
Gibson et al.

(10) Patent No.: US 6,517,331 B1
(45) Date of Patent: Feb. 11, 2003

(54) OIL INLET FOR A WOBBLE PLATE PUMP

(75) Inventors: Dennis H. Gibson, Chillicothe, IL (US); Eric S. Keyster, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/672,324

(22) Filed: Sep. 28, 2000

Related U.S. Application Data

(63) Continuation-in-part of application No. 09/450,887, filed on Nov. 29, 1999.

(60) Provisional application No. 60/111,387, filed on Dec. 8, 1998.

(51) Int. Cl.[7] ..... F04B 7/04

(52) U.S. Cl. ..... 417/490; 417/270

(58) Field of Search ..... 417/490, 269, 417/270; 91/490, 499, 485; 92/71, 165 R

(56) References Cited

U.S. PATENT DOCUMENTS 2,821,932 A * 2/1958 Lucien ..... 417/269
2,918,012 A * 12/1959 Lucien ..... 417/270
3,257,960 A * 6/1966 Keel ..... 417/269
5,279,205 A * 1/1994 Carlson, Jr. et al. ..... 91/485
5,738,000 A * 4/1998 Forster ..... 92/165 R

FOREIGN PATENT DOCUMENTS

JP 08159237 * 6/1996

* cited by examiner

*Primary Examiner*—Teresa Walberg
*Assistant Examiner*—Quang Van
(74) *Attorney, Agent, or Firm*—Eric M Bram; Liell & McNeil

(57) ABSTRACT

A displacement pump includes a rotatable drive shaft; a low-pressure hydraulic fluid reservoir; at least one piston containing a piston cavity; and a drive plate connected with the drive shaft. The drive plate includes an inlet passage and a fill slot. The fill slot is fluidly connected with the low pressure hydraulic fluid reservoir via the inlet passage. The drive plate is rotatable about the drive shaft such that as the drive plate rotates, the piston cavity is intermittently fluidly connected with the fill slot.

20 Claims, 5 Drawing Sheets

OIL INLET FOR A WOBBLE PLATE PUMP

RELATION TO OTHER PATENT APPLICATIONS

This is a continuation-in-part application of nonprovisional patent application serial No. 09/450,887, entitled "Hydrostatic Thrust Bearing for a Wobble Plate Pump," filed Nov. 29, 1999, which claims benefit of prior provisional application serial No. 60/111,387 filed Dec. 8, 1998.

TECHNICAL FIELD

The present invention relates generally to pumps and hydraulically-actuated systems used with internal combustion engines, and more particularly to axial hydraulic pumps with wobble plates.

BACKGROUND ART

Hydraulic pumps that utilize wobble plates to drive reciprocating pistons are susceptible to wear. The wobble plate is usually the drive plate with a tilted pumping surface that pushes against the pump'pistons. As the drive plate rotates each piston is pushed away from the drive plate as the thickness of the drive plate beneath it becomes greater with the rotation, causing the piston to compress. The hydraulic pressure within the piston increases as the volume within the piston decreases. This high pressure hydraulic fluid is generally the output product of the hydraulic pump. As rotation continues and the thickness of the drive plate beneath the piston lessens, the higher hydraulic pressure within the piston allows it to expand again and refill itself with lower pressure hydraulic fluid.

There is generally friction between the drive plate and the piston as the drive plate rotates. This can cause wear to the piston and drive plate surfaces. Additionally, there is generally friction and wear against other surfaces that the rotating drive plate comes in contact with, as well.

Of course, the drive plate and whenever holds it must also be capable of bearing the loads caused by pushing against the compressing pistons. These loads may be axial (i.e., parallel to the drive shaft axis and/or perpendicular to the plaintiff rotation of the drive plate) or radial (i.e., perpendicular to the drive shaft axis), or some combination thereof.

DISCLOSURE OF THE INVENTION

In one aspect of the invention, a displacement pump comprises a rotatable drive shaft; a low-pressure hydraulic fluid reservoir; at least one piston containing a piston cavity; and a drive plate connected with the drive shaft. The drive plate includes an inlet passage and a fill slot. The fill slot is fluidly connected with the low pressure hydraulic fluid reservoir via the inlet passage. The drive plate is rotatable about the drive shaft such that as the drive plate rotates the piston cavity is intermittently fluidly connected with the fill slot.

BEST MODE FOR CARRYING OUT THE INVENTION

Figure 1:
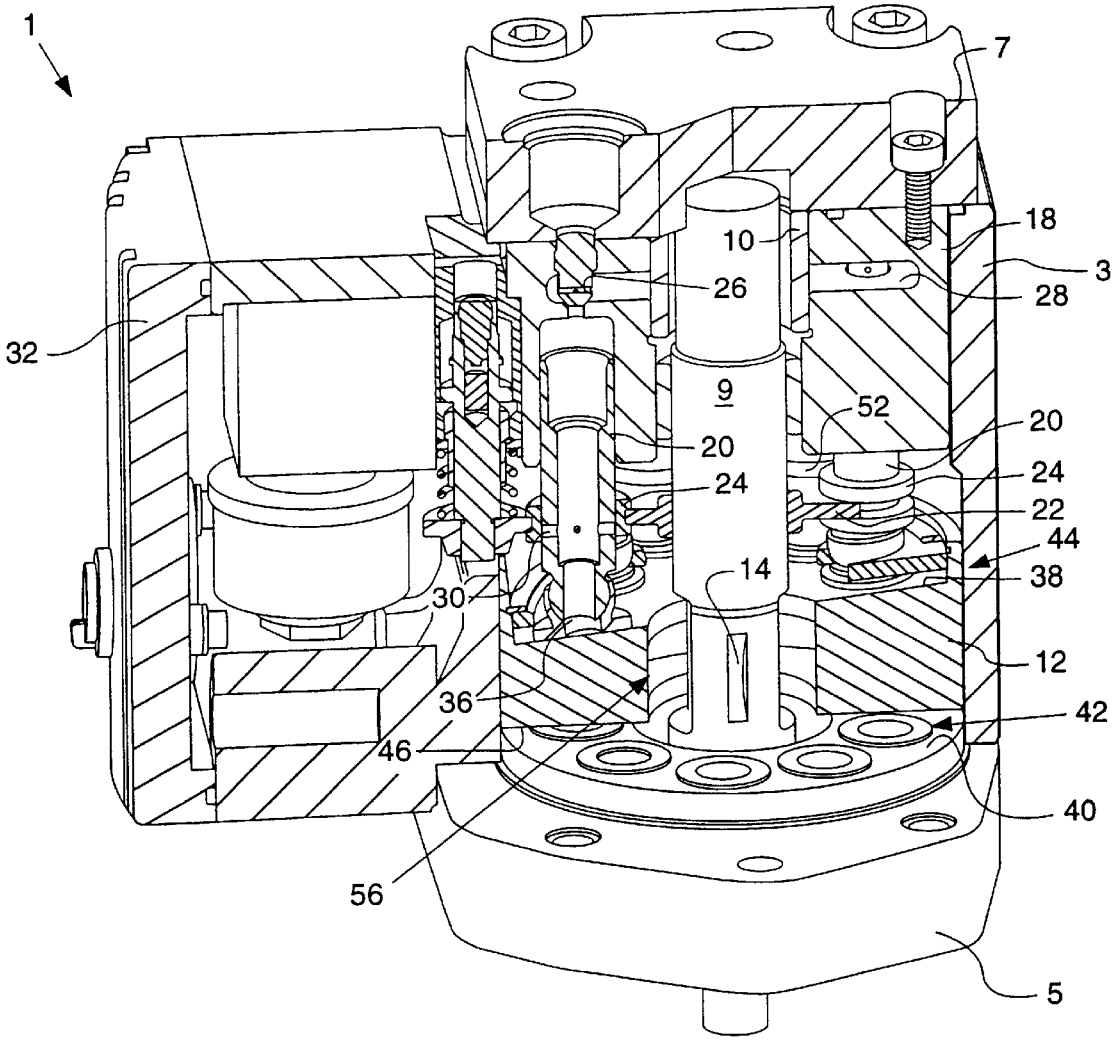
FIG. 1 is a combination perspective and cross-sectional diagrammatic view of a fixed displacement pump according to the invention.

With reference to FIGS. 1–5, a pump 1 utilizing the invention comprises a housing 3 between a front flange 5 and an end cap 7. A drive shaft 9 driven by an engine (not shown) extends into the pump 1, supported by a bearing collar 10 or needle. The drive shaft 9 in this embodiment is connected with a wobble plate type drive plate 12 in a keyway drive configuration in which a key (not shown) fits into a drive shaft slot 14 and a drive plate slot 16 in the drive plate 12. Other configurations utilizing the invention are possible, but a keyway drive or other configuration that allow the drive plate 12 to rotate nonrigidly is preferred.

A barrel 18 bolted to the end cap 7 holds a number of pistons 20 (nine in this embodiment) that are connected to one another by a connector 22. Each piston 20 is slidably held within a respective sleeve 24. A one-way outlet check nozzle 26 at the top end of each piston 20 allows compressed hydraulic fluid to exit each piston 20 into a collector ring 28 of high pressure hydraulic fluid for output from the pump 1.

Bleed holes 30 are situated in each piston 20 in the area of its respective sleeve 24. An electro-hydraulic control unit 32 can control the vertical position of each sleeve 24 on its respective piston 20, to control discharge of the pump 1 by selectively allowing the sleeves 24 to cover or uncover the bleed holes 30 during a variable portion of piston 20 compression.

Each piston 20 is connected with a respective piston shoe 34 by means of a flexible joint, a ball joint 36 for example. so that the piston shoes 34 can conform to the slanted pumping surface 38 of the drive plate 12 as it rotates. The drive plate 12 in turn rests against a hydrostatic thrust barring plate 40 on the front flange 5. The hydrostatic barring plate 40 comprises a number of thrust pads 42, each positioned directly beneath a respective one of the piston 20. Hydraulic fluid (e.g., engine oil) from within the low pressure fluid area or interior 52 of the pump 1 forms a hydrodynamic journal bearing 44 between the drive plate 12 and the housing 3 as the drive plate .12 rotates.

Figure 2:
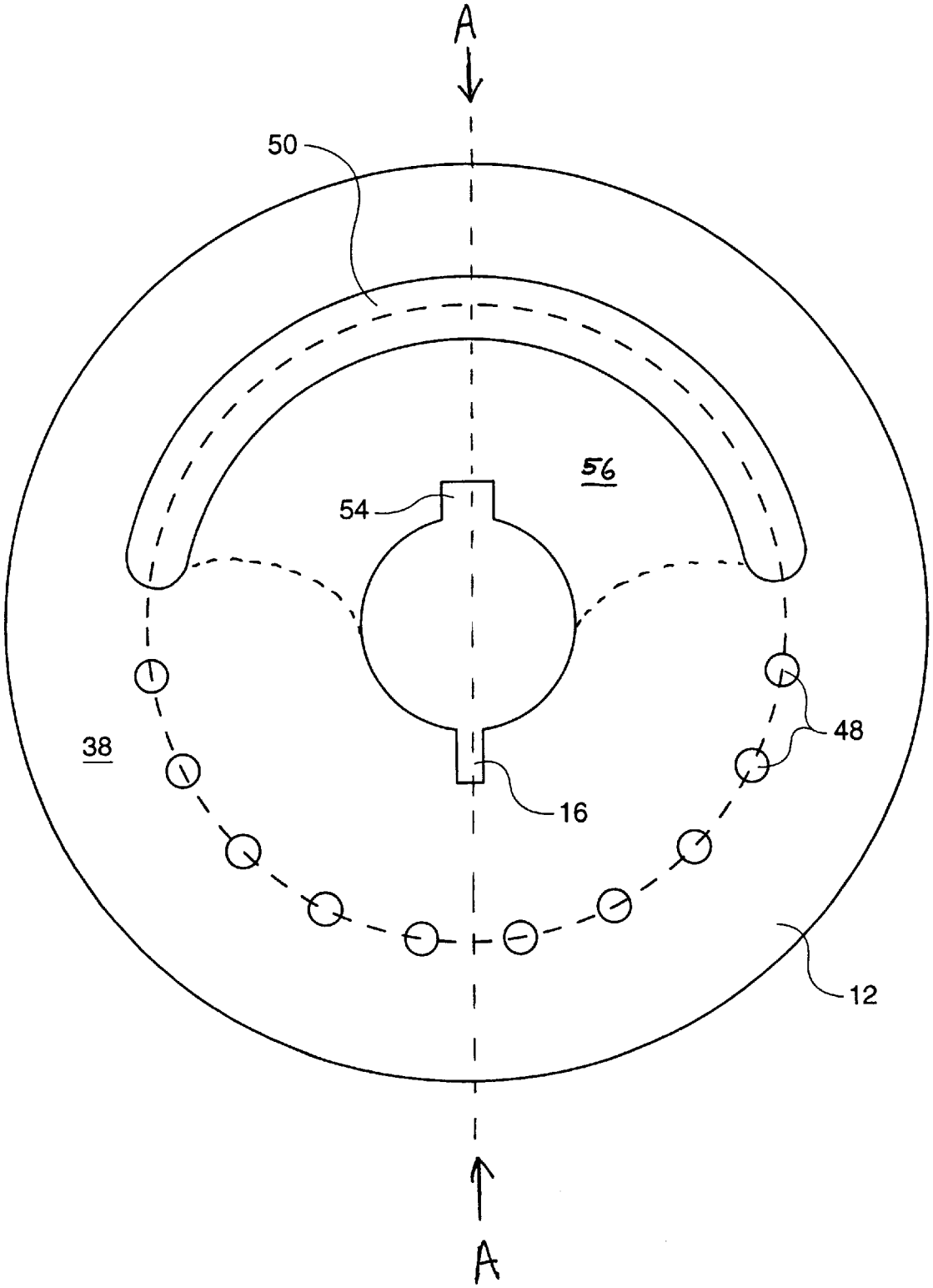
FIG. 2 is a top view of the drive plate of the pump of FIG. 1.
Figure 3:
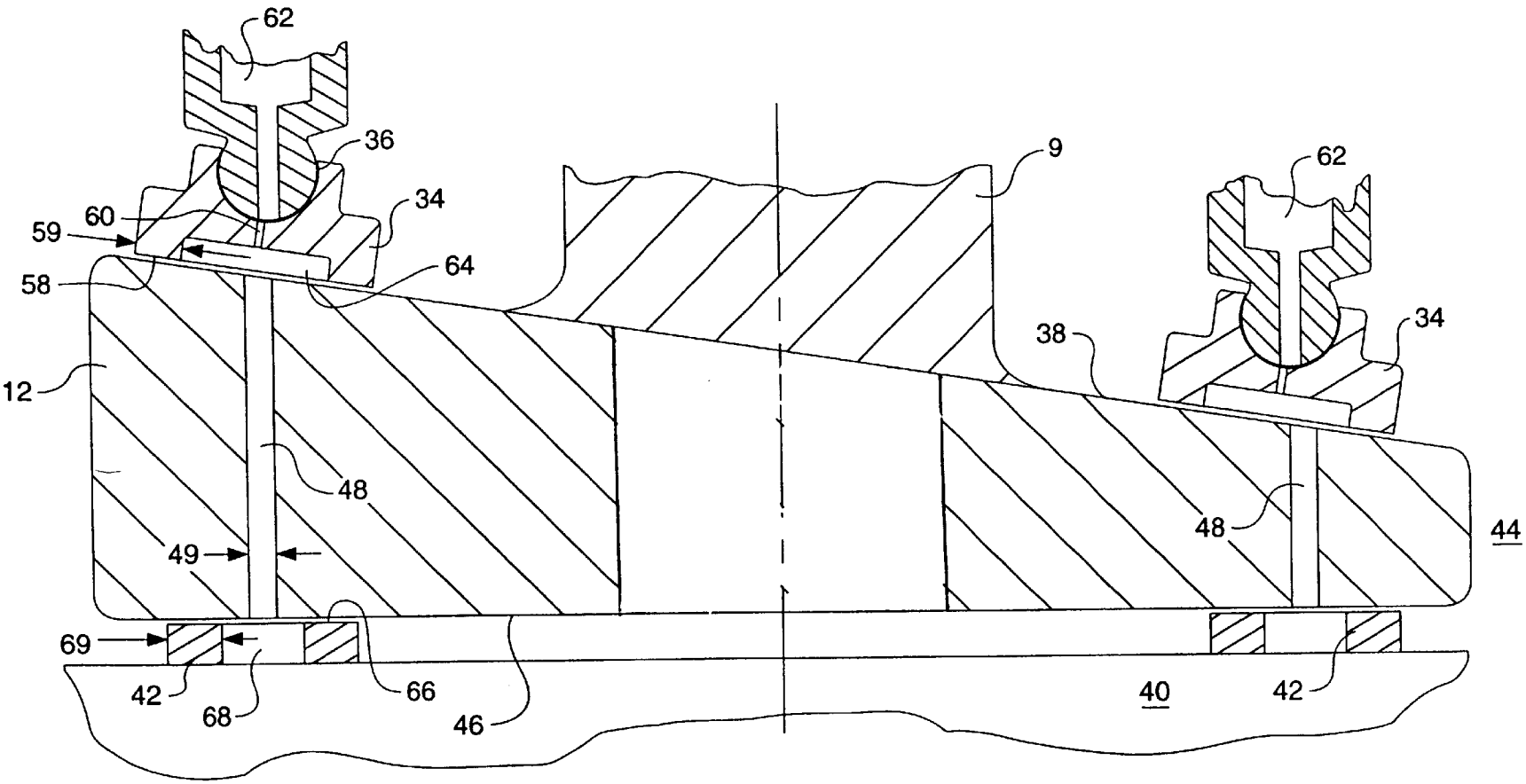
FIG. 3 is a cross-sectional view of a drive plate portion of the pump of FIG. 1.

With reference to FIGS. 1–3, the drive plate 12 has a bearing surface 46 separated from the pumping surface 38 by an annular inner surface and an annular outer surface. The drive plate 12 contains several communication ports 48 that pass through the drive plate 12 between the pumping surface 38 and the bearing surface 46. The communication ports 48 define a predetermined diameter 49. The communication ports 48 of this embodiment are generally parallel with the drive shaft 9. However, other communication port 48 configurations may be used, such as non-parallel, flared, and frustoconical.

Figure 6:
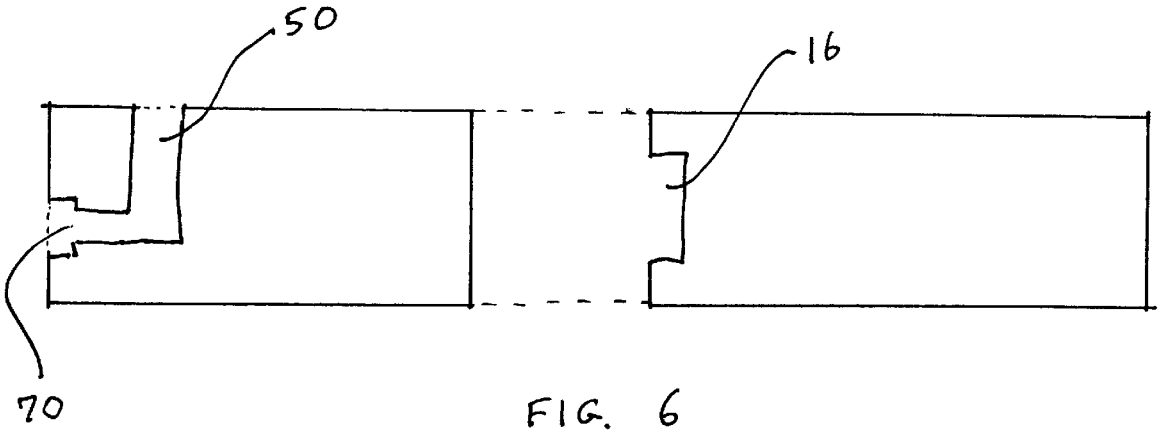
FIG. 6 is a cross-sectional view similar to FIG. 5, but of a different embodiment drive plate of the invention.

A fill slot 50 is formed in the pumping surface 38 and is always open to a low pressure hydraulic fluid area 52 within the pump 1 that acts as a reservoir of oil or other hydraulic fluid. For example, in FIG. 5 the fill slot 50 is connected with the low pressure hydraulic fluid area 52 via an inner fill inlet 54 connected with an inner fill cavity 56. In another embodiment shown in FIG. 6, the fill slot 50 is connected with the low pressure hydraulic fluid area 52 via an outer fill inlet 70 that communicates with a passage (not shown) in the housing 3 opposite the hydrodynamic journal bearing 44. In other embodiments (not shown) the fill slot 50 could be connected with the low pressure hydraulic fluid area 52 via an inlet in the pumping surface 38 or the bearing surface 46.

Each piston shoe 34 has a flat shoe sill 58 for engaging the drive plate 12 and a shoe passage 60 that allows hydraulic fluid from a piston cavity 62 within the piston 20 to pass to a hydrostatic bearing shoe area 64. Each shoe sill 58 has a predetermined width 59 that corresponds in magnitude to the diameter 49 of the communication port 48. It is well known in the art to determine the hydrostatic bearing shoe area 64 by estimating an effective force diameter (not shown) that is generally equal to the bearing shoe area 64 plus half the predetermined width 59 of the shoe sills 58, i.e mean diameter of the shoe sill. The effective force diameter is at least 90% of the piston diameter (not shown) and preferably between 96% to 98% of the piston diameter.

Similarly each thrust pad 42 has a thrust pad sill 66 and a hydrostatic bearing pad area 68. Each hydrostatic bearing pad area 68 has a second predetermined width 69 that corresponds in magnitude to the diameter 49 of the communication port 48. It is well known in the art to determine the hydrostatic bearing pad area 68 by estimating an effective force diameter (not shown) that is generally equal to the bearing pad area 68 plus half the second predetermined width 69 of the thrust pad sills 66, i.e. the mean diameter of the thrust pad sills 66. The effective force diameter is at least 90% of the piston diameter and preferably between 96% to 98% of the piston diameter. It should also be recognized that the thrust pad 42 maybe located on the bearing surface of the drive plate without departing from the spirit of the invention.

Industrial Applicability

The keyway drive or other nonrigid rotation drive arrangement allows the drive shaft 9 to rotate the drive plate 12 in a nonrigid manner. The rotation of the drive plate 12 causes the pistons 20 to reciprocate up and down. The pistons 20 are connected with the piston shoes 34 that engage the drive plate 12 by ball joints 36, which allows the pistons 20 to maintain a vertical alignment. The axial loads caused by the pistons 20 pushing on the drive plate 12 are balanced by the thrust pads 42, as described below. Because the pumping surface 38 is tilted there are some radial loads, but the radial loads are small, and are easily handled by the hydrodynamic journal bearing 44 that forms between the drive plate 12 and the housing 3 as the drive plate 12 rotates.

As the drive shaft 9 rotates to push a piston 20 up, the communication ports 48 pass between the hydrostatic bearing shoe area 64 of the piston shoe 34 and the hydrostatic bearing pad area 68 of the thrust pad 42 beneath the piston 20. When this occurs high pressure hydraulic fluid from the piston 20 being compressed immediately flows into both the hydrostatic bearing shoe area 64 and the hydrostatic bearing pad area 68.

This allows the piston shoe 34 and the thrust pad 42 to act as hydrostatic bearings to support the thrust forces, since the hydraulic fluid pressure in the hydrostatic bearing areas 64, 68 are equal and match the axial piston load. By means well known in the art, the surface areas of the shoe sills 58 and of the thrust pad sills 66 can be chosen so that hydraulic fluid from the hydrostatic bearing areas 64, 68 flows to form nearly frictionless fluid buffers between the shoe sill 58 and drive plate 12, and between the thrust pad sill 66 and drive plate 12, respectively. For example, good results are obtained when the mean diameter of each shoe sill 58 and pad sill 66 are at least 90% of the piston diameter and preferably between 96% to 98% of the piston diameter.

Figure 4:
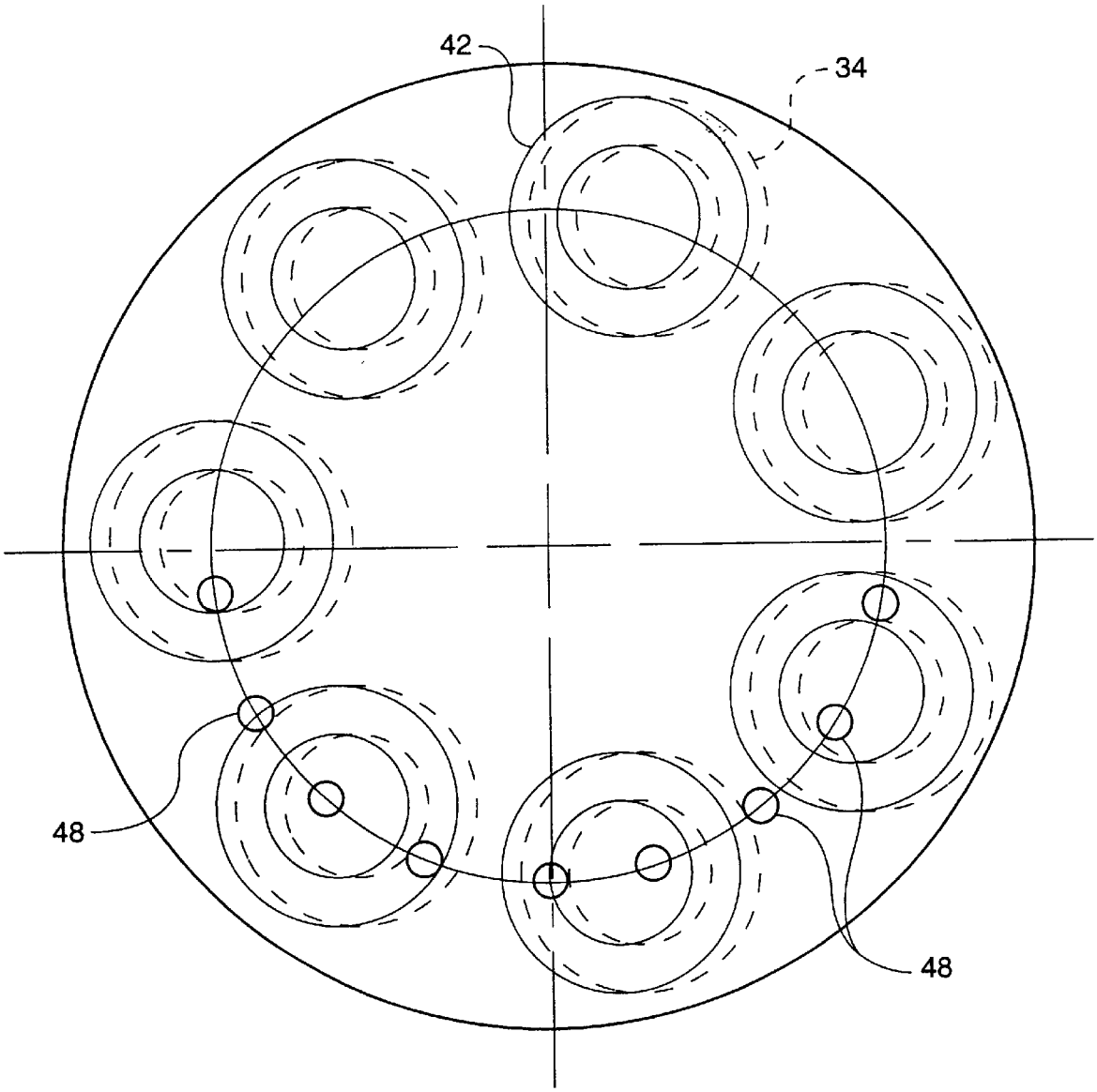
FIG. 4 is a projectional view of one possible placement configuration for proper alignment of piston shoes, thrust pads, and communication ports according to the invention.
Figure 5:
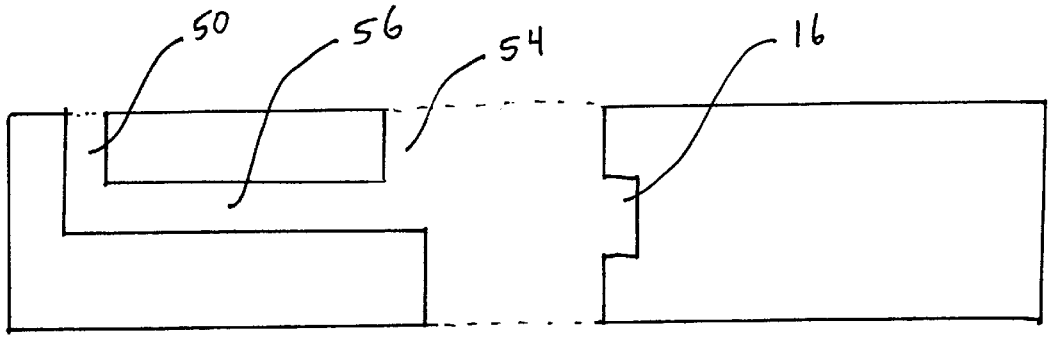
FIG. 5 is a cross-sectional view of the drive plate of FIG. 2 along the line A—A of FIG. 2.

As can be seen in FIG. 4, the communication ports 48 are situated in the drive plate 12 such that whenever a piston 20 is being pushed upward, pressurizing hydraulic fluid for pumping, there is always at least one communication port 48 connecting that piston'shoe 34 with its corresponding thrust pad 42. This creates the balanced hydrostatic bearing supporting the thrust on both sides of the drive plate 12.

Further, the strength of each hydrostatic bearing varies to accommodate the variable axial forces generated as the pistons 20 are vertically displaced, because the pressure in the hydrostatic bearing areas 64, 68 is always equal to the pressure within the piston cavity 62. Thus, most of the axial load caused by each piston 20 is carried by the thin film of hydraulic fluid between its piston shoe 34 and the drive plate 12, and by the thin film of hydraulic fluid between the corresponding thrust bearing and the drive plate 12. These thin films of hydraulic fluid keep friction, and therefore wear, to a minimum.

Meanwhile, the high pressure hydraulic fluid in the piston cavity 62 can pass through the outlet check valve 26 into the collector ring 28 and hence to the pump output (not shown). The electro-hydraulic control unit 32 can adjust the positions of the piston sleeves 24 to control the discharge of the pump 1 by controlling the amount of time the bleed holes 30 are blocked by the sleeves 24 during piston compression.

As the drive plate 12 continues to rotate so that the piston 20 begins to move downward, the hydrostatic bearing shoe area 64 is exposed to the fill slot 50 on the pumping surface 38 of the drive plate 12. The fill slot 50 is always exposed to the low pressure hydraulic fluid within the pump 1 via the inner fill inlet 54 and the inner fill cavity 56, so that as the piston 20 moves downward the piston cavity 62 fills with low pressure hydraulic fluid from the fill slot 50 via the shoe passage 60.

While each piston 20 is directly over its respective thrust pad 42, it's piston shoe 34 is slightly offset because the pumping surface 38 is tilted, as can be understood from the projection view of FIG. 4. For best results, the predetermined width of the shoe sills 58 and the second predetermined width 69 of the thrust pad sills 66 should be at least equal to the diameter 49 of the communication ports 48. Furthermore, the communication ports 48 should be placed so that as the drive plate 12 rotates a communication port 48 opens onto a hydraulic bearing shoe area 64 at the same time it opens onto the corresponding hydraulic bearing pad area 68, as demonstrated in FIG. 4. This allows the pressures in the two hydraulic bearing areas to build up at the same time, so that the loads on each piston shoe 34 and its corresponding thrust bearing remain balanced.

The above description is intended for illustrative purposes only. Thus, those skilled in the art will appreciate that various modifications can be made to the illustrated embodiment without departing from the spirit and scope of the present invention, which is recited in the claims set forth below.

What is claimed is:

1. A displacement pump comprising:

a rotatable drive shaft;

a low-pressure hydraulic fluid reservoir;

at least one piston containing a piston cavity; and a drive plate connected with the drive shaft, the drive plate including an inlet passage and a fill slot, the fill slot being fluidly connected with the low pressure hydraulic fluid reservoir via the inlet passage, the drive plate being rotatable about the drive shaft such that as the drive plate rotates the piston cavity is intermittently fluidly connected with the fill slot.

2. The pump of claim 1, wherein the inlet passage includes an inner fill cavity and a fill inlet, the fill inlet being partially defined by the drive shaft.

3. The pump of claim 1, including:

a piston shoe flexibly connected with the piston, the piston shoe including a shoe passage fluidly connected with the piston cavity; and a hydrostatic thrust bearing plate including at least one thrust pad, the drive plate being disposed between the piston shoe and the thrust pad, the drive plate including a bearing surface proximate to the thrust pad, a pumping surface proximate to the piston shoe, and at least one communication port fluidly connecting the bearing surface with the pumping surface, the drive plate being rotatable to a position in which the piston cavity is fluidly connected with the thrust pad via the shoe passage and the communication port.

4. The pump of claim 3, wherein the inlet passage includes an inner fill cavity and a fill inlet, the fill inlet being located in one of the pumping surface and the bearing surface.

5. The pump of claim 3, wherein said drive plate includes a plurality of said communication ports, and the drive plate is rotatable to sequentially allow each of the plurality of communication ports to fluidly connect said piston cavity with said thrust pad.

6. The pump of claim 5, wherein:

said piston shoe partially defines a hydrostatic bearing shoe area contiguous to said drive plate;

said piston shoe includes a shoe passage fluidly connecting the hydrostatic bearing shoe area with said piston cavity; and said piston shoe further includes a shoe sill for engaging said drive plate, the shoe sill surrounding the hydrostatic bearing shoe area.

7. The pump of claim 6, wherein said shoe sill has a mean diameter at least 90% of the piston diameter.

8. The pump of claim 6, wherein said shoe sill has a mean diameter between 96% and 98% of the piston diameter.

9. The pump of claim 6, wherein said shoe sill has a predetermined width at least equal to said predetermined diameter of said communication port.

10. The pump of claim 3, wherein said drive shaft is nonrigidly connected with said drive plate.

11. The pump of claim 3, wherein said drive shaft is comprised by a keyway drive for rotating said drive plate.

12. A displacement pump comprising:

a rotatable drive shaft;

a low pressure hydraulic fluid reservoir;

at least one piston containing a piston cavity;

a drive plate connected with the drive shaft, the drive plate including an inlet passage and a fill slot, the fill slot being fluidly connected with the low pressure hydraulic fluid reservoir via the inlet passage, the drive plate being rotatable about the drive shaft such that as the drive plate rotates the piston cavity is intermittently fluidly connected with the fill slot;

a piston shoe flexibly connected with the piston, the piston shoe including a shoe passage fluidly connected with the piston cavity;

a hydrostatic thrust bearing plate including at least one thrust pad;

the drive plate being disposed between the piston shoe and the thrust pad, the drive plate including a bearing surface proximate to the thrust pad, a pumping surface proximate to the piston shoe, and at least one communication port fluidly connecting the bearing surface with the pumping surface;

the drive plate being rotatable to a position in which the piston cavity is fluidly connected with the thrust pad via the shoe passage and the communication port;

said thrust pad partially defines a hydrostatic bearing pad area contiguous to said drive plate; and said thrust pad further includes a thrust pad seal for engaging said drive plate, the thrust pad seal surrounding the hydrostatic bearing pad area.

13. The pump of claim 12, wherein said shoe sill has a mean diameter at least 90% of the piston diameter.

14. The pump of claim 12, wherein said shoe sill has a mean diameter between 96% and 98% of the piston diameter.

15. The pump of claim 10, wherein said shoe seal has a predetermined width at least equal to said predetermined diameter of said communication port.

16. A displacement pump comprising:

a rotatable drive shaft;

a drive plate operably coupled to said drive shaft and including a pump surface slanted with respect to a centerline of said drive shaft;

a fill slot formed in said pump surface; and an inlet passage disposed in said drive plate and opening into said fill slot.

17. The pump of claim 16 wherein said drive plate includes an annular inner surface; and said inlet passage opens through said annular inner surface.

18. The pump of claim 16 wherein said drive plate includes an annular surface separating said pump surface from a bearing surface;

a plurality of hydrostatic bearing communication ports disposed in said drive plate and extending between said pump surface and said bearing surface.

19. The pump of claim 16 wherein said drive plate includes an annular outer surface; and said inlet passage opens through said annular outer surface.

20. The pump of claim 16 wherein said drive plate includes an annular outer surface; and said annular outer surface including a hydrodynamic journal bearing surface.

* * * * *